US009228709B2

(12) United States Patent
Hatch

(10) Patent No.: US 9,228,709 B2
(45) **Date of Patent: *Jan. 5, 2016**

(54) RECESSED LED LIGHTING FIXTURE

(71) Applicant: Michael L. Hatch, Tampa, FL (US)

(72) Inventor: Michael L. Hatch, Tampa, FL (US)

(73) Assignee: Hatch Transformers, Inc., Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,468

(22) Filed: Oct. 15, 2014

(65) Prior Publication Data

US 2015/0029732 A1 Jan. 29, 2015

Related U.S. Application Data

(63) Continuation of application No. 13/826,783, filed on Mar. 14, 2013, now Pat. No. 8,888,326.

(51) Int. Cl.

| | |
|---|---|
| ***F21V 15/00*** | (2015.01) |
| ***F21S 8/02*** | (2006.01) |
| ***F21V 15/01*** | (2006.01) |
| ***F21V 27/02*** | (2006.01) |
| ***F21V 23/02*** | (2006.01) |
| ***F21K 99/00*** | (2010.01) |
| *F21Y 101/02* | (2006.01) |
| *F21V 29/77* | (2015.01) |

(52) U.S. Cl.

CPC . *F21S 8/026* (2013.01); *F21K 9/90* (2013.01); *F21V 15/01* (2013.01); *F21V 23/02* (2013.01); *F21V 23/026* (2013.01); *F21V 27/02* (2013.01); *F21V 29/773* (2015.01); *F21Y 2101/02* (2013.01); *Y10S 362/80* (2013.01); *Y10T 29/49117* (2015.01)

(58) Field of Classification Search

CPC ..... F21S 8/026; F21V 23/02; F21K 9/90; F21Y 2101/02; B01D 39/14

USPC ..... 362/365; 29/820

See application file for complete search history.

(56) References Cited

U.S. PATENT DOCUMENTS

| | | | | |
|---|---|---|---|---|
| 7,614,769 | B2 | 11/2009 | Sell | |
| 8,042,973 | B2 | 10/2011 | Inoue et al. | |
| 8,066,407 | B2 | 11/2011 | Remus et al. | |
| 8,096,671 | B1 | 1/2012 | Cronk et al. | |
| 8,393,764 | B2 | 3/2013 | Yao | |
| 8,414,152 | B2 | 4/2013 | Yen | |
| 8,439,531 | B2 | 5/2013 | Trott et al. | |
| 8,888,326 | B2 * | 11/2014 | Hatch | 362/249.02 |
| 2015/0029732 | A1 * | 1/2015 | Hatch | 362/365 |

* cited by examiner

*Primary Examiner* — Anabel Ton

(74) *Attorney, Agent, or Firm* — Reinhart Boerner Van Deuren P.C.

(57) ABSTRACT

A recessed LED light fixture is provided. The fixture includes a housing assembly, a power supply, and a light source. The power supply is positioned below the light source relative to an opening of the housing from which light from the light source is emitted. The power supply is positioned on an exterior side of the housing and proximate a lower-most extent of the housing.

10 Claims, 11 Drawing Sheets

RECESSED LED LIGHTING FIXTURE

CROSS-REFERENCE TO RELATED PATENT APPLICATION

This patent application is a Continuation co-pending U.S. patent application Ser. No. 13/826,783, filed Mar. 14, 2013, the entire teachings and disclosure of which are incorporated herein by reference thereto.

FIELD OF THE INVENTION

This invention generally relates to light fixtures, and more particularly to recessed light fixtures.

BACKGROUND OF THE INVENTION

The movement towards greater energy efficiency and "greener" technologies has had a large impact in the area of building construction, both in the residential and commercial context. One area of continued focus is the lighting used in such buildings. There is a growing trend of utilizing LED (light emitting diode) type lighting in both the residential and commercial context, given the decreased power consumption and longer service life of such lighting.

As one particular example, there is a growing trend of utilizing LED type light sources in recessed lighting fixtures. A typical recessed lighting fixture will have a housing that extends into a ceiling, typically. The housing has a bottom face that is generally flush with ceiling. An opening is formed in the bottom face, which leads into a recess of the housing. An LED light source is positioned within the recess. Such assemblies have been readily adopted given their reduced power consumption and longer service life. They may be utilized in new construction, or as a retrofit of an existing recessed light that utilizes a conventional filament based bulb as a light source.

However, there are several disadvantages with such assemblies. First, they typically incorporate a power supply that is positioned above the LED light source within the housing. This power supply receives input power from the installation site (e.g. a consumer's residential power grid) and converts it to the particular power supply required by the LED light source. Because the power supply is positioned above the light source, it is generally in a location within the housing that operates at an elevated temperature due to the heat generated by the light source.

Operating in this elevated temperature environment restricts the maximum power output of the power supply, as it must not exceed a specified temperature during normal operation. In other words, given that the power supply is already at an elevated temperature due to its location, the heat generated by the operation of the power supply must not elevate the operating temperature of the power supply beyond the aforementioned limit. As a result, the overall maximum power output of the power supply must be carefully reduced and controlled to maintain a safe operating temperature, taking into account the baseline temperature of the power supply due to its location above the light source.

Second, situating the power supply above the light source reduces the distance taken from the light source to the opening of the housing from which light will be emitted. In other words, in order to maintain a generally desirable and standard overall height, additional housing space is sacrificed to make room for the power supply above the light source, thereby situating the light source closer to the opening of the housing.

Such a configuration is not desirable because, as the light source moves closer to the opening, the amount of glare produced by the light is increased. Further, as the light source moves closer to the opening, it becomes visible to a consumer at a large range of angles. Seeing the actual light source is aesthetically displeasing, and as stated above, increases the glare produced by the light.

As such, there is a need in the art for a recessed LED lighting fixture that overcomes existing problems in the art by providing a high power output potential, with a reduced glare and improved aesthetics. The invention provides such a recessed LED lighting fixture. These and other advantages of the invention, as well as additional inventive features, will be apparent from the description of the invention provided herein.

BRIEF SUMMARY OF THE INVENTION

In one aspect, a recessed LED lighting fixture is provided. An embodiment of such a recessed LED lighting fixture includes a housing assembly having an opening in a bottom face thereof. The opening communicates with a recess of the housing assembly. A LED light source is positioned within the recess of the housing assembly such that it emits light through the opening of the housing assembly. A power supply is mounted to the housing assembly below the LED light source.

In certain embodiments, the housing assembly comprises a housing body and a movable housing cover. The removable housing cover includes an arm. A channel is defined between the arm and an outer surface of the housing body. The channel routes input power lead wires to the power supply.

In certain embodiments, the LED light source includes at least one LED on a circuit board. In a subsidiary embodiment, the at least one LED includes a plurality of LEDs.

In certain embodiments, the housing assembly includes a trim ring for flush-mounting the housing assembly to a mounting surface. The power supply is mounted to the trim ring. In a subsidiary embodiment, the power supply is radially exterior of the recess of the housing assembly.

The power assembly may be ring-shaped and surround the housing assembly.

In another aspect, a recessed LED lighting fixture is provided. An embodiment of such a recessed LED lighting fixture includes a housing assembly having an opening in a bottom face thereof. The opening communicates with a recess of the housing assembly. A LED light source is positioned within the recess of the housing assembly such that it emits light through the opening of the housing assembly. A power supply is mounted to an exterior of the housing assembly such that it is radially outside of the recess.

In certain embodiments, the power supply is mounted to the housing assembly below the LED light source such that it is axially interposed between the LED light source and the opening.

In certain embodiments, the housing assembly recess is divided, by a dividing wall, into an upper cavity and a lower cavity. The LED light source is mounted to the dividing wall within the lower cavity. The housing assembly includes a housing cover and a housing body. The housing body defines the upper and lower cavities. The housing cover caps the upper cavity and includes an arm which extends axially along a length of the housing body and encloses a channel between the housing body and the arm. Electrical power input lead wires extend through an opening in the cover, into the upper cavity, through the channel, and connect to the power supply.

Electrical power output lead wires extend from the power supply, through the channel, into the upper cavity, through an opening formed in the dividing wall, and connect with the LED light source.

In certain embodiments, the housing body includes a flange-shaped trim ring surrounding the opening. The power supply is mounted to an upper surface of the trim ring. The power supply surrounds a radially outer-most wall of the housing body which forms a boundary of the upper and lower cavities. In certain embodiments, the power supply circumscribes the lower cavity. In certain embodiments, the power supply is ring-shaped.

In yet another aspect, a method for retrofitting a structure with a recessed LED lighting fixture is provided. An embodiment of such a method includes the steps of removing an existing recessed lighting fixture, and thereafter, installing a recessed LED lighting fixture. The recessed LED lighting fixture including a housing assembly having an opening in a bottom face thereof. The opening communicates with a recess of the housing assembly. A LED light source is positioned within the recess of the housing assembly such that it emits light through the opening of the housing assembly. A power supply is mounted to the housing assembly below the LED light source such that it is axially interposed between the opening and the LED light source.

In a subsidiary embodiment, the step of installing includes flush-mounting a trim ring of the housing assembly with a mounting surface. The power supply is mounted to an upper surface of the trim ring and is radially outside of the recess of the housing assembly.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
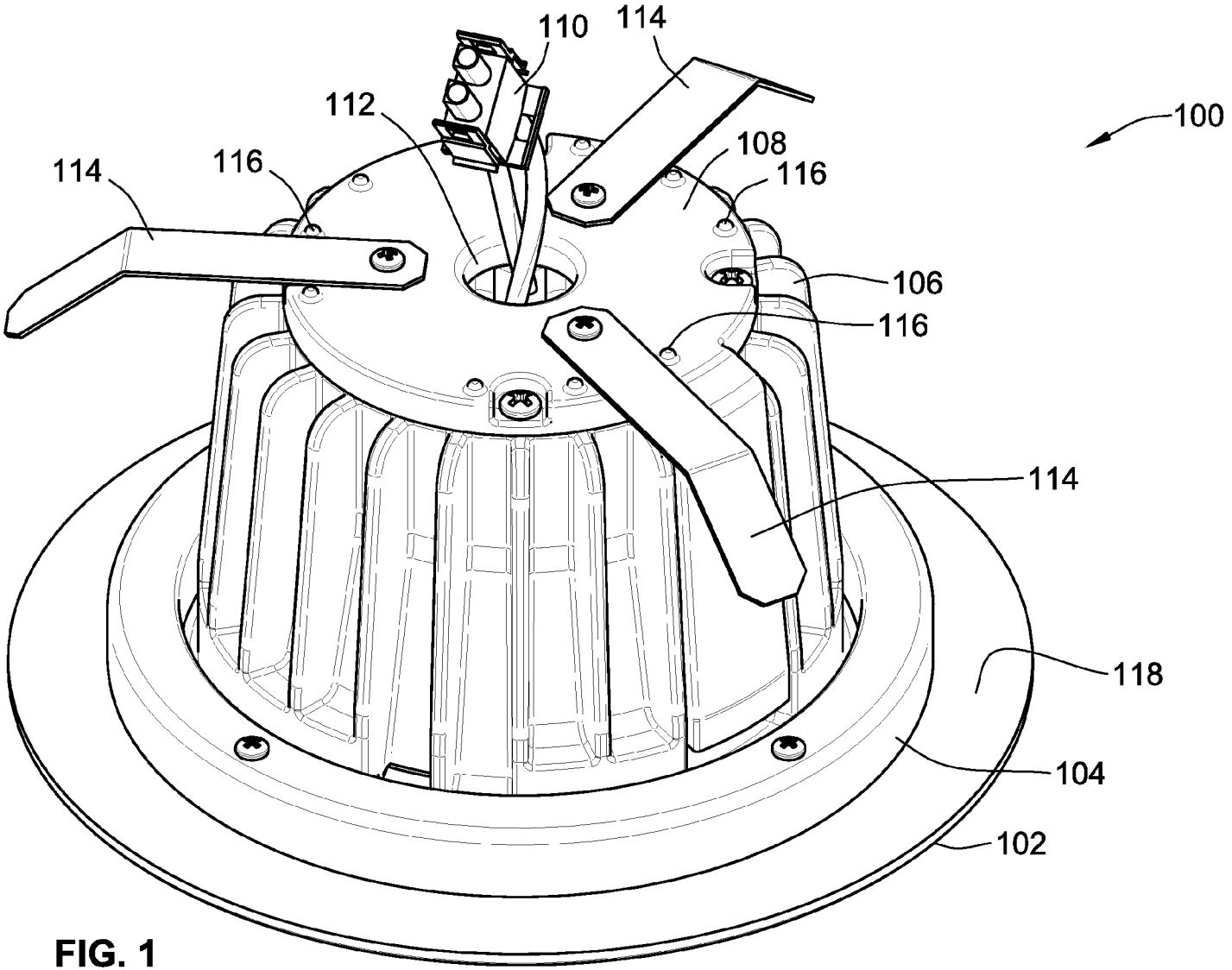
FIG. 1 is a perspective view of an exemplary embodiment of a recessed LED lighting fixture according to the teachings of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, an exemplary embodiment of a recessed LED lighting fixture 100 (hereinafter referred to as "light fixture") is illustrated. Light fixture 100 includes a generally cylindrically-shaped housing assembly 102, with a generally ring-shaped power supply 104 mounted to an exterior of the housing assembly 102. As will be explained in greater detail below, power supply 104 is mounted axially below a light source of light fixture 100 such that the heat generated by the aforementioned light source has little-to-no effect upon power supply 104. Advantageously, power supply 104 may be rated at higher power outputs, and not exceed an upper operating temperature limit. Further, by situating power supply 104 below the light source, the light source of light fixture 100 may be positioned deeper into a recess of housing assembly 102 to thereby reduce glare and line-of-sight to the actual light source contained therein.

Although the embodiment illustrated and described herein incorporates a cylindrically-shaped housing assembly, and a ring-shaped power supply, those skilled in the art will immediately recognize that other housing and power supply sizes and shapes are possible in accordance with the teachings herein.

The housing assembly includes a housing body 106 and a housing cover 108. The housing body 106 may incorporate heat sink fins as illustrated, or may omit the same and have a generally smooth outer surface. A lead wire assembly 110 protrudes through an opening 112 formed in housing cover 108. Lead wire assembly 110 includes a plug-style termination as shown, however, other terminations are contemplated (e.g. bare wires, tin connections, etc.). A plurality of mounting clips 114 are attached to housing cover 108 and facilitate the mounting of light fixture 100. A plurality of locating detents 116 are formed on housing cover 108 for situating and maintaining the orientation of mounting clips 114. Mounting clips 114 are generally resilient and thus can flex and adjust to reposition the same. Additionally, although three mounting clips 114 are illustrated, it will be recognized that fewer or greater mounting clips 114 may be utilized.

Figure 2:
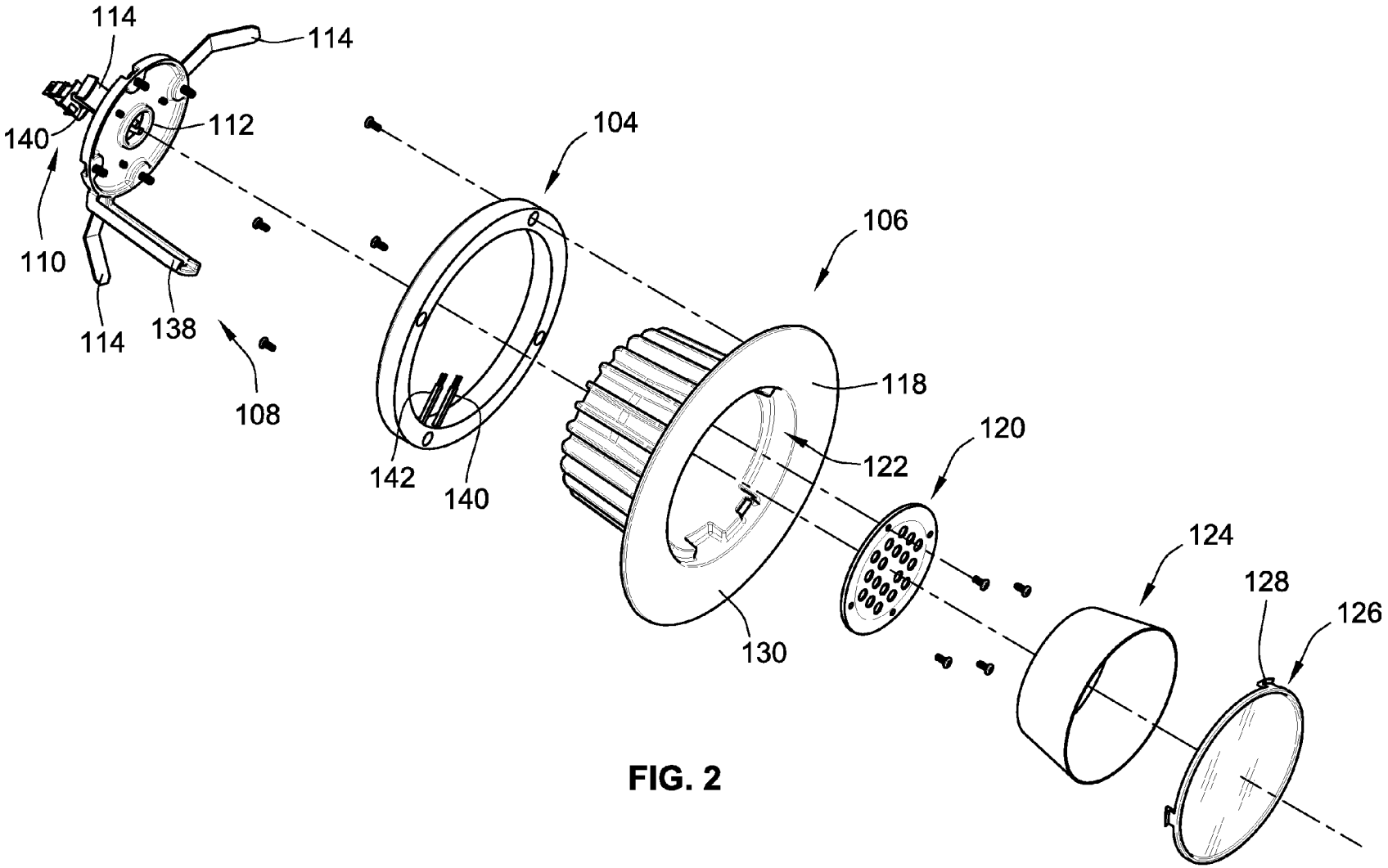
FIG. 2 is a perspective exploded view of the embodiment of FIG. 1.

Turning now to FIG. 2, housing body 106 includes a flange-like trim ring 118 which surrounds an opening 122 formed in a bottom face 130 of housing body 106. Although illustrated as forming a part of housing body 106, trim ring 118 may be a separate component. A light source 120 is installed through opening 122. Light source 120 is an LED-type light source and its associated circuitry. In the illustrated embodiment, light source 120 incorporates a plurality of LEDs. However, in other embodiments, a single LED may be utilized. A reflector 124 is also installed through opening 122 and within a recess of housing body 106. Reflector 124 is operable to direct light generated by light source 120 out of opening 122. As indicated above, because power supply 104 is not situated above light source 120, the recess of housing body 106 is generally deeper than prior designs to permit the deeper internal placement of light source 120. Such a configuration also allows for the use of a generally elongated reflector 124 as shown, which ultimately provides a more aesthetically pleasing lighting effect. A lens 126 closes opening 122 and additionally provides for aesthetically pleasing light distribution. Lens 126 installed within opening 122 using clips 128 formed thereon. In other embodiments, lens 126 may be omitted entirely.

Figure 3:
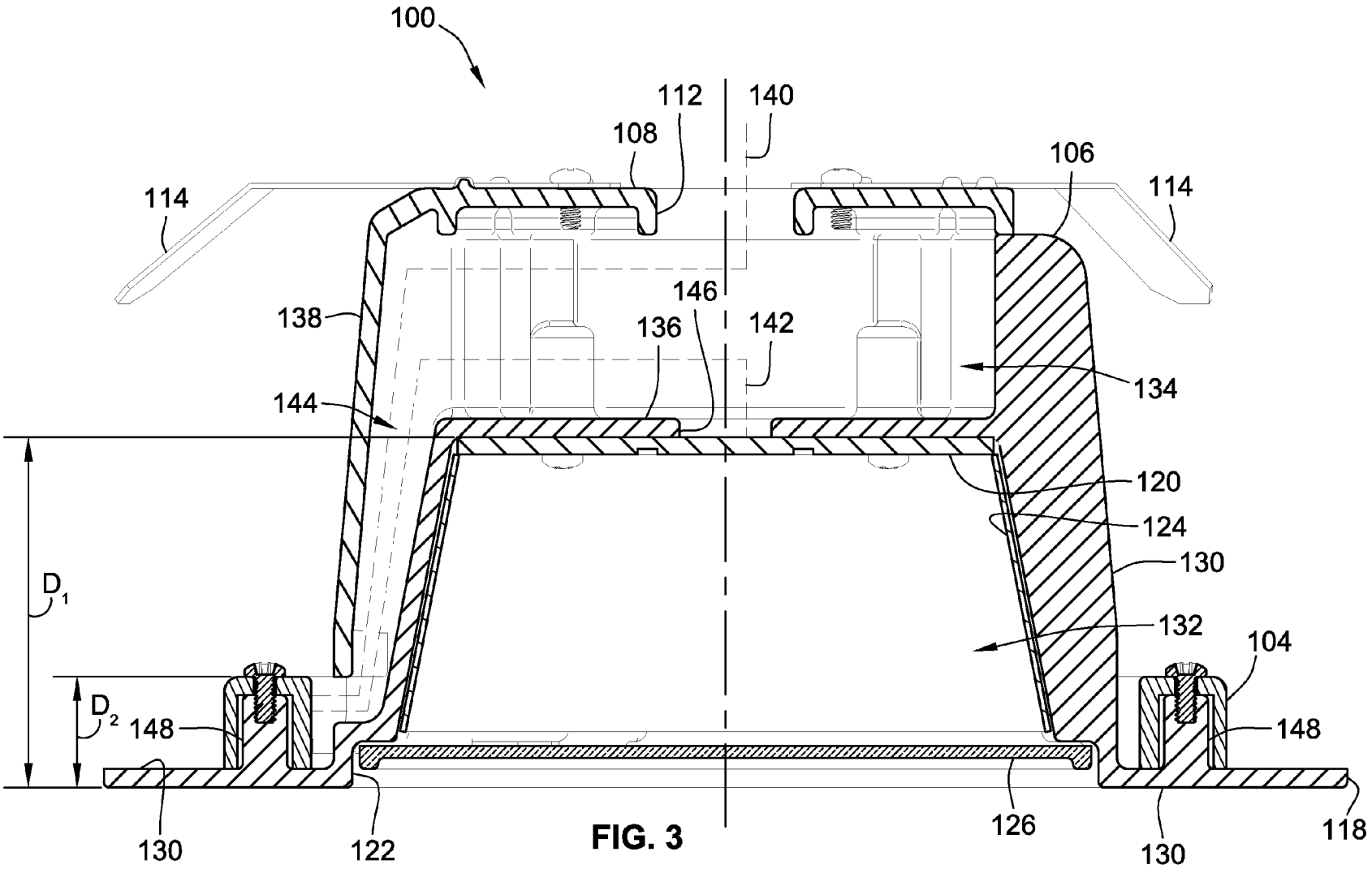
FIG. 3 is a side cross section of the embodiment of FIG. 1.

With reference now to FIG. 3, light fixture 100 is illustrated in a cross-sectional view for the aforementioned recess of housing body 106 may be described in greater detail. The recess of housing body 106 is divided into a lower cavity 132 and an upper cavity 134 separated by a dividing wall 136. Housing cover 108 includes a downwardly depending arm 138 which extend axially along a length of housing body 106.

A channel 144 is formed between a radial outer-most surface of housing body 106 in a radial inner surface of arm 138. Channel 144 acts as a conduit for the routing for power supply input lead wire 140 of lead wire assembly 110 (See FIG. 1) to power supply 104.

Indeed, power supply input leads 140 extend through opening 112 formed in housing cover 108, through upper cavity 134, downwardly through channel 144, and connect to power supply 104. In turn, power supply output leads 142 extend from power supply 104, upwardly through channel 144, into upper cavity 132, and through an aperture 146 formed in dividing wall 136 to ultimately connect with light source 120 and provide input power thereto.

As can also be seen in this illustration, an axial upper-most extent of light source 120 is spaced from bottom face 130 of housing body 106 at a distance $D_1$. An upper-most axial extent of power supply 104 is spaced from bottom face 130 of housing body at a distance $D_2$. $D_2$ is less than $D_1$. In other words, power supply 104 is interposed between opening 122 and light source 120. As a result, the heat generated by light source 120 has little to no effect upon power supply 104. Further, because power supply 104 is situated on an exterior of housing body 106, it can readily transfer heat to its ambient environment. Contrast this with prior designs which situate a power supply above a light source and within a cavity of a housing. In such designs, the power supply is already in an operating environment at an elevated temperature. Once the power supply begins its own operation, the heat generated thereby will ultimately raise the temperature of such a power supply. As a result, the power supply has a limited power output to avoid overheating the power supply entirely.

Such disadvantages are not present in the embodiment illustrated in FIG. 3 given that power supply 104 is positioned below light source 120, and exterior to housing body 106.

Figure 4:
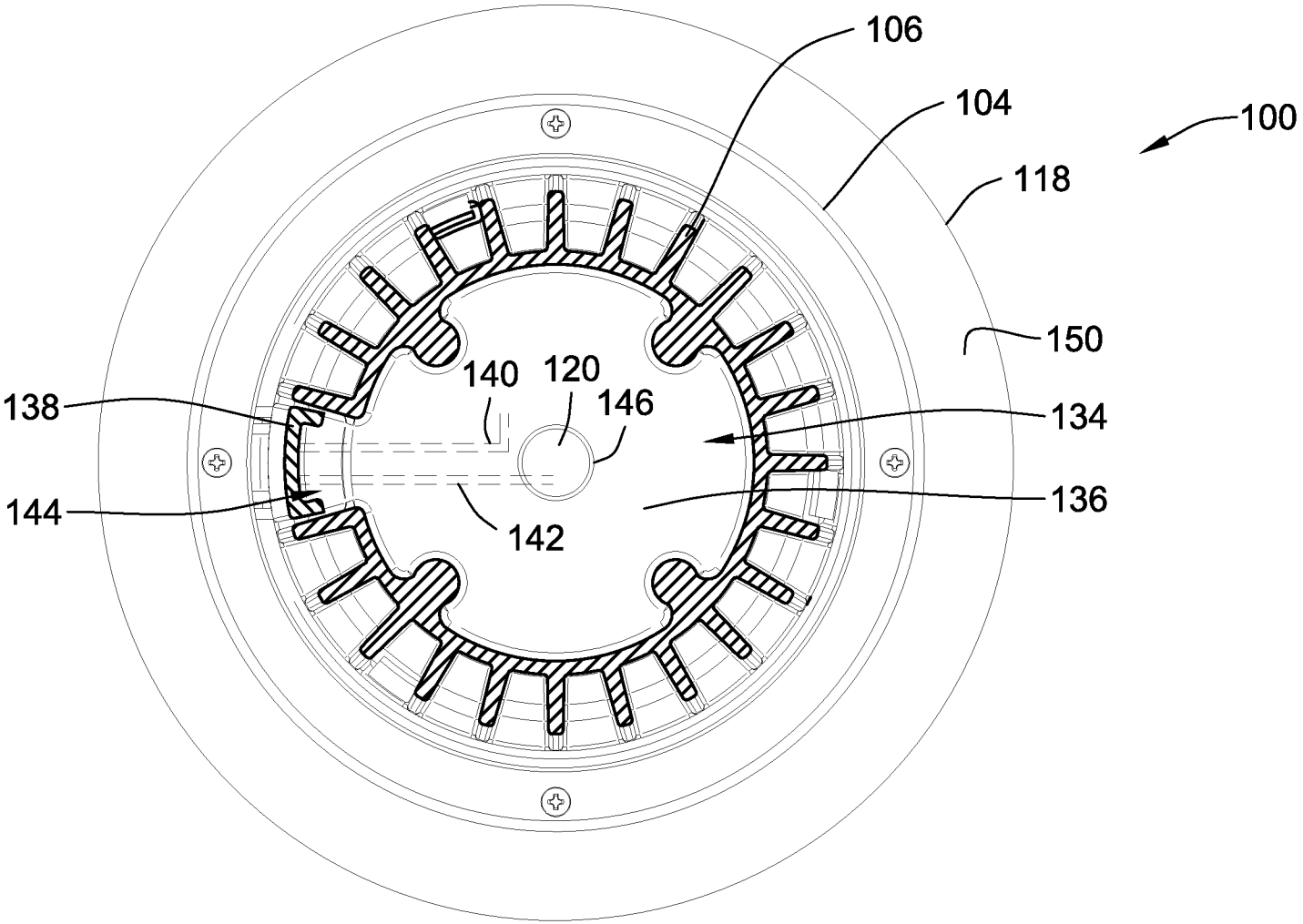
FIG. 4 is a top cross section of the embodiment of FIG. 1.
Figure 5:
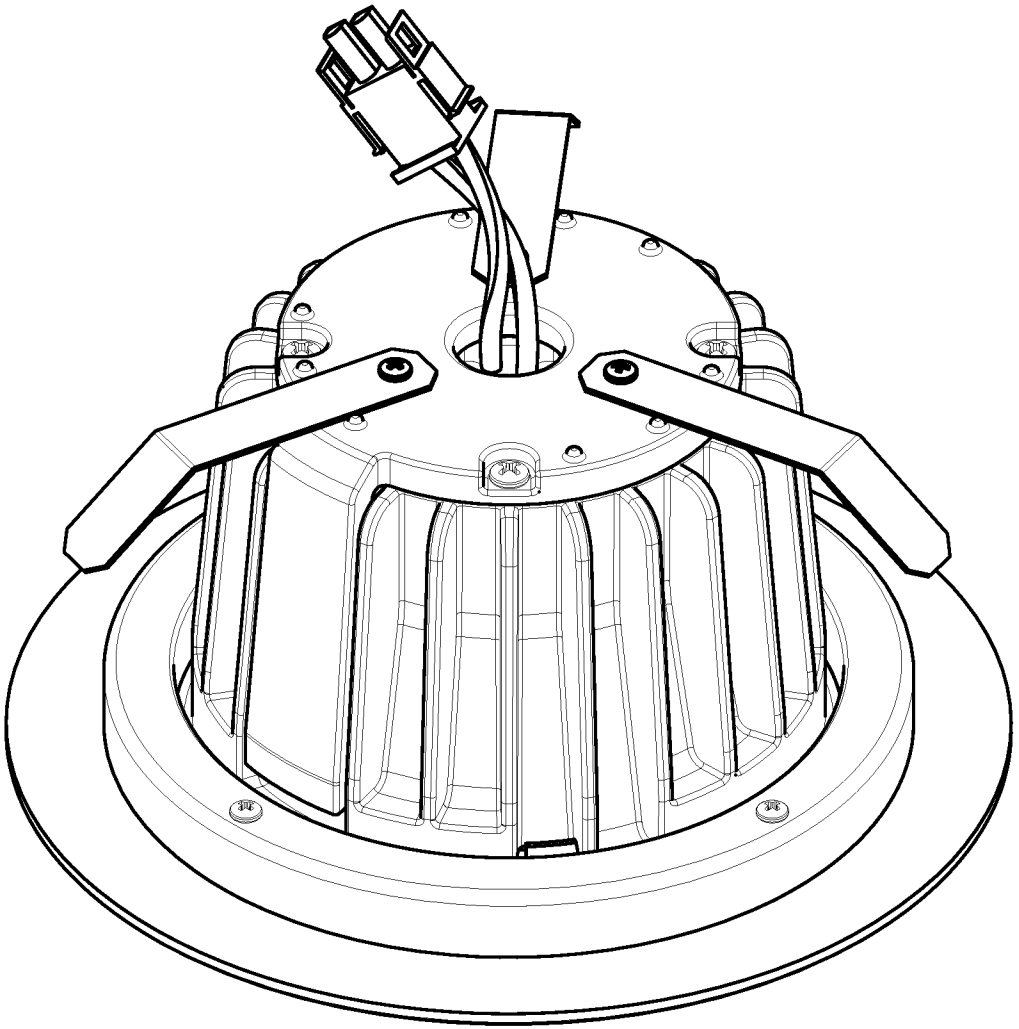
FIG. 5 is another perspective view of the embodiment of FIG. 1.
Figure 6:
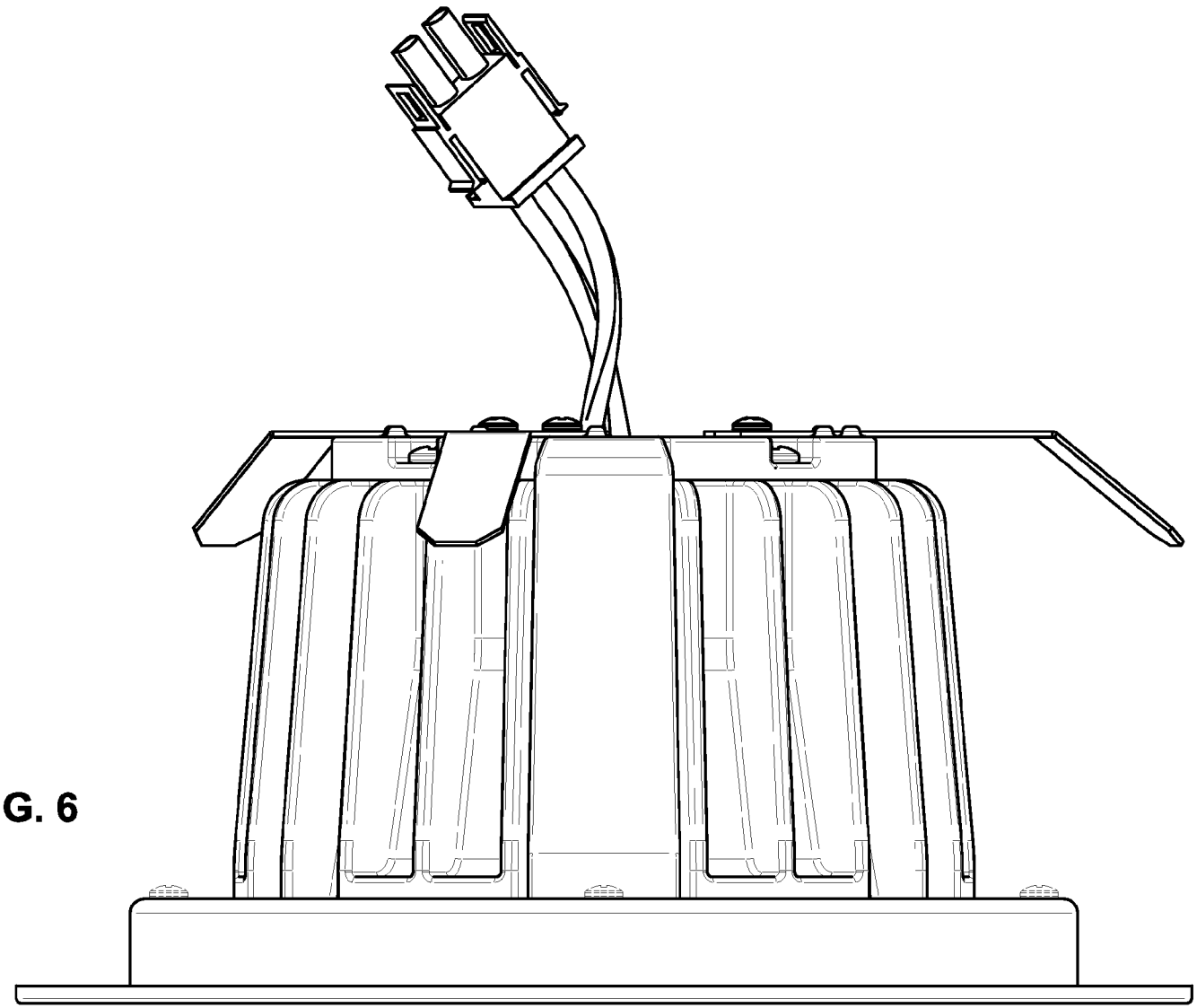
FIG. 6 is a side view of the embodiment of FIG. 1.
Figure 7:
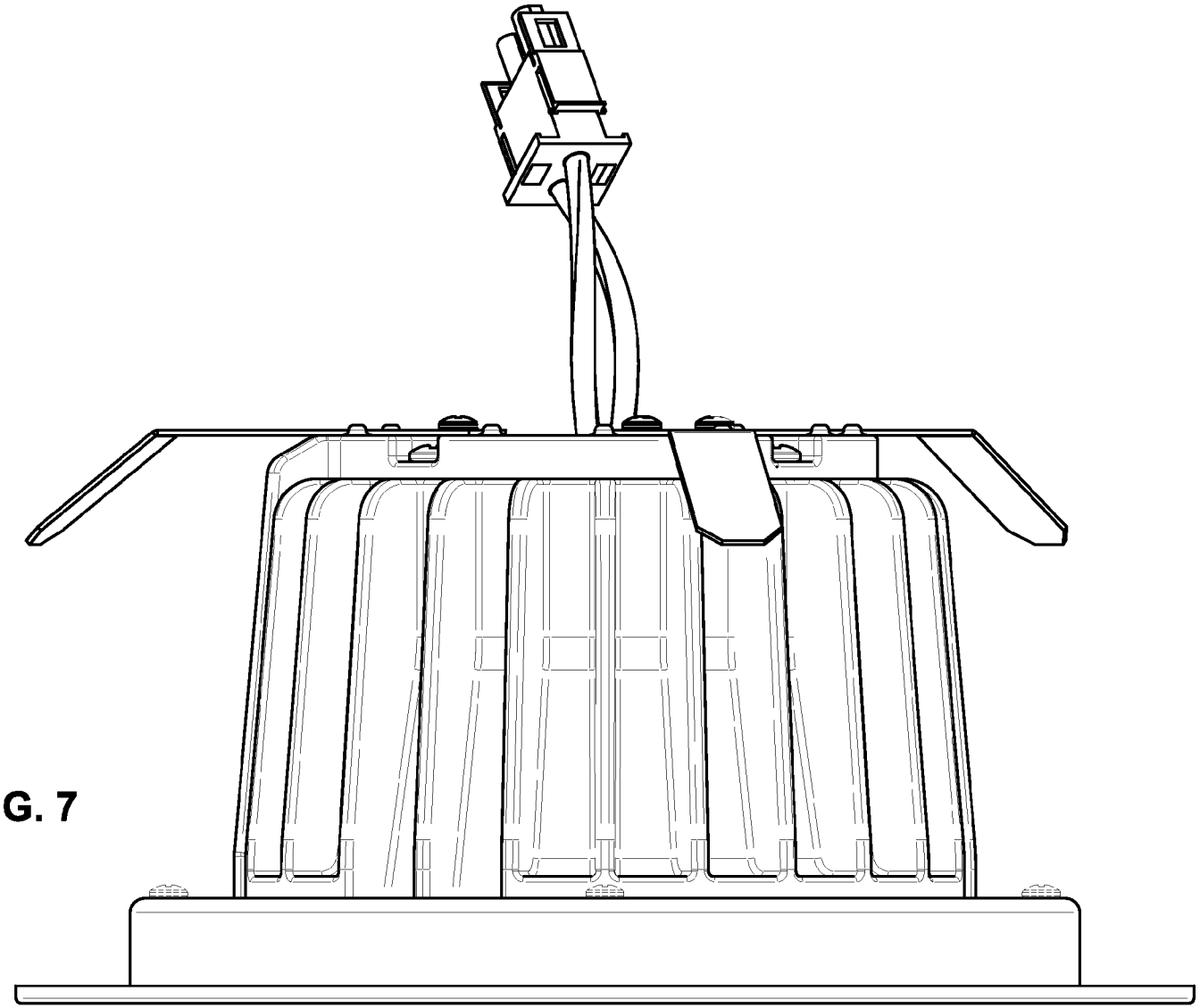
FIG. 7 is another side view of the embodiment of FIG. 1; opposite the side view shown in FIG. 6.
Figure 8:
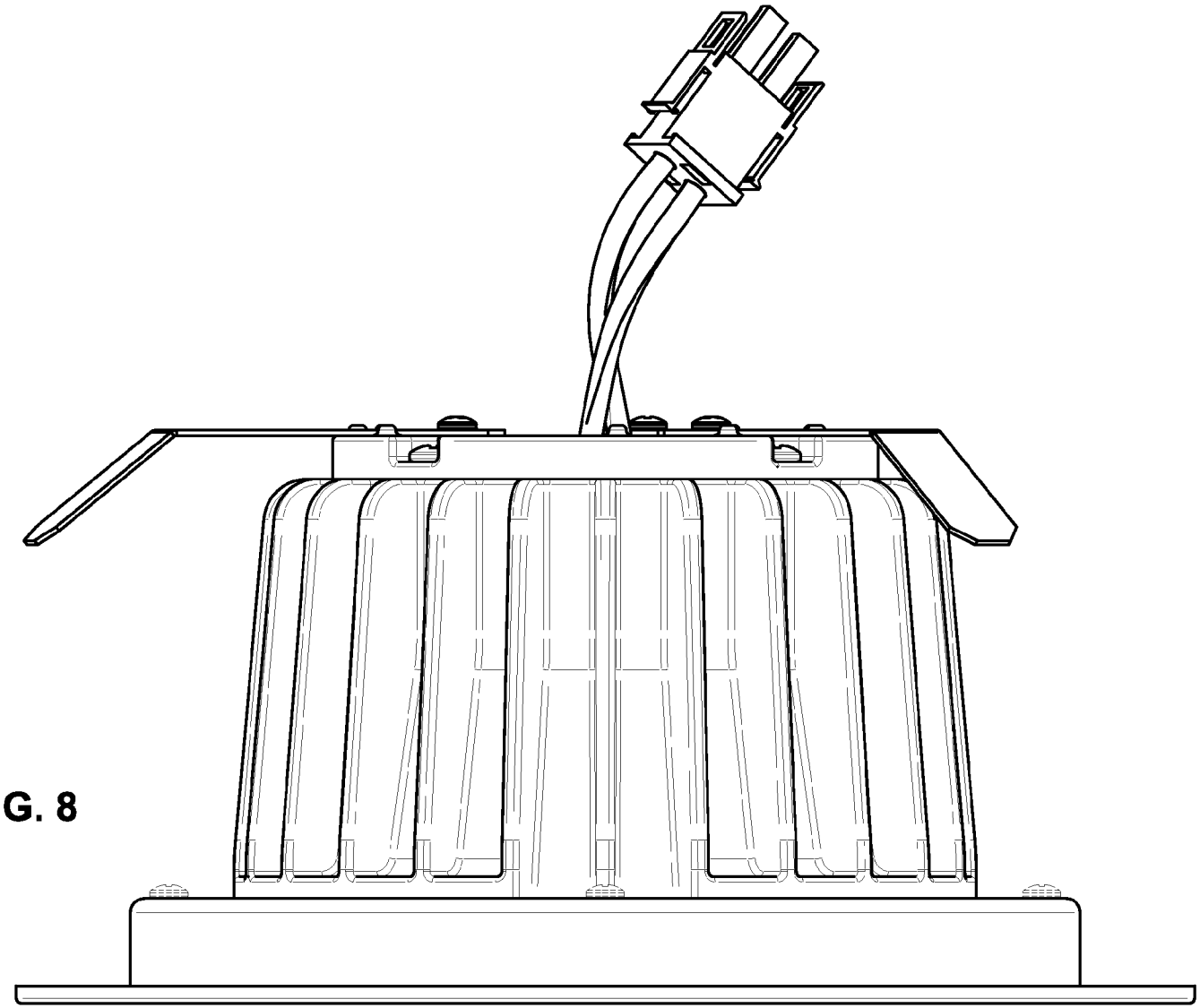
FIG. 8 is a front view of the embodiment of FIG. 1.
Figure 9:
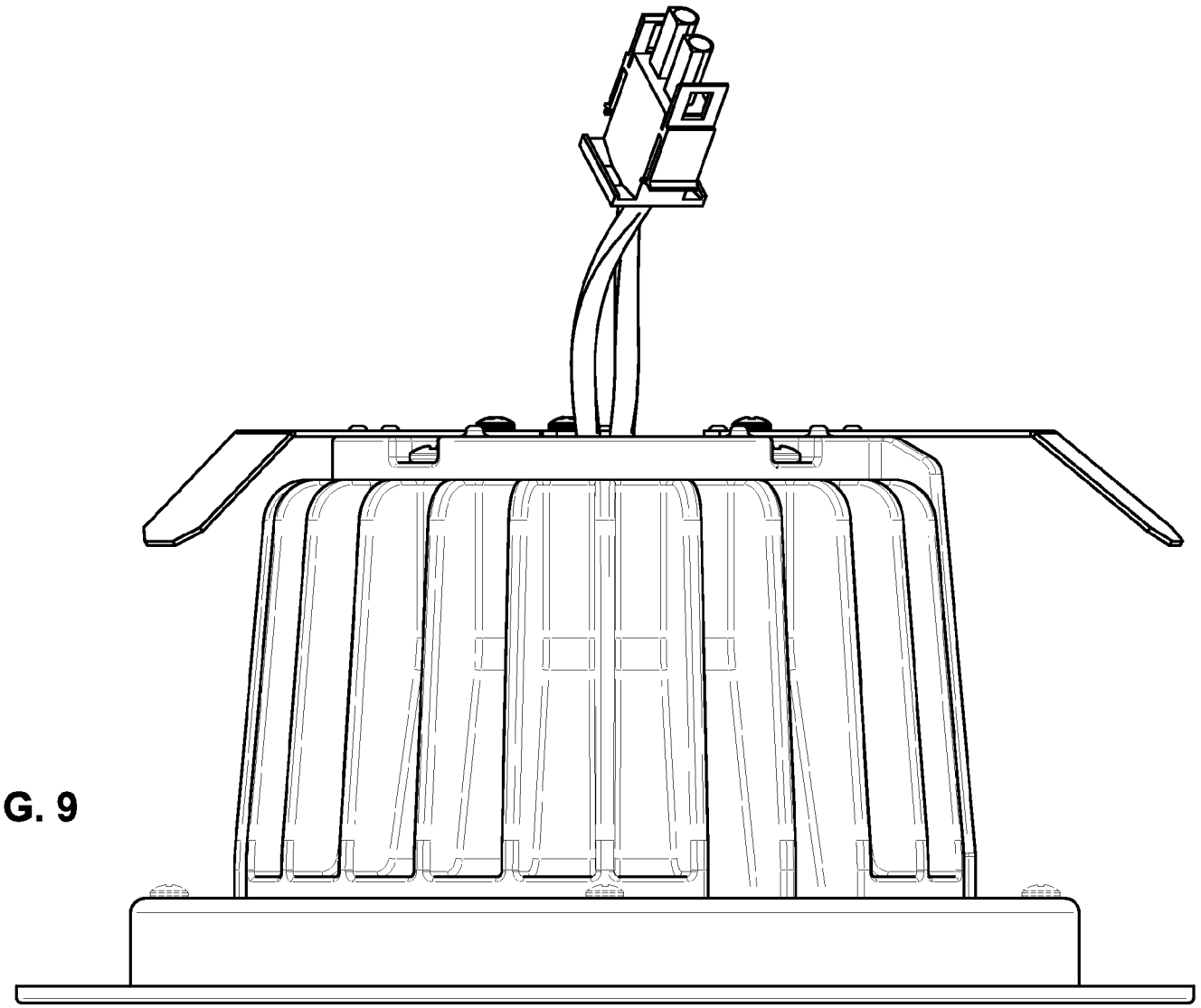
FIG. 9 is a back view of the embodiment of FIG. 1.
Figure 10:
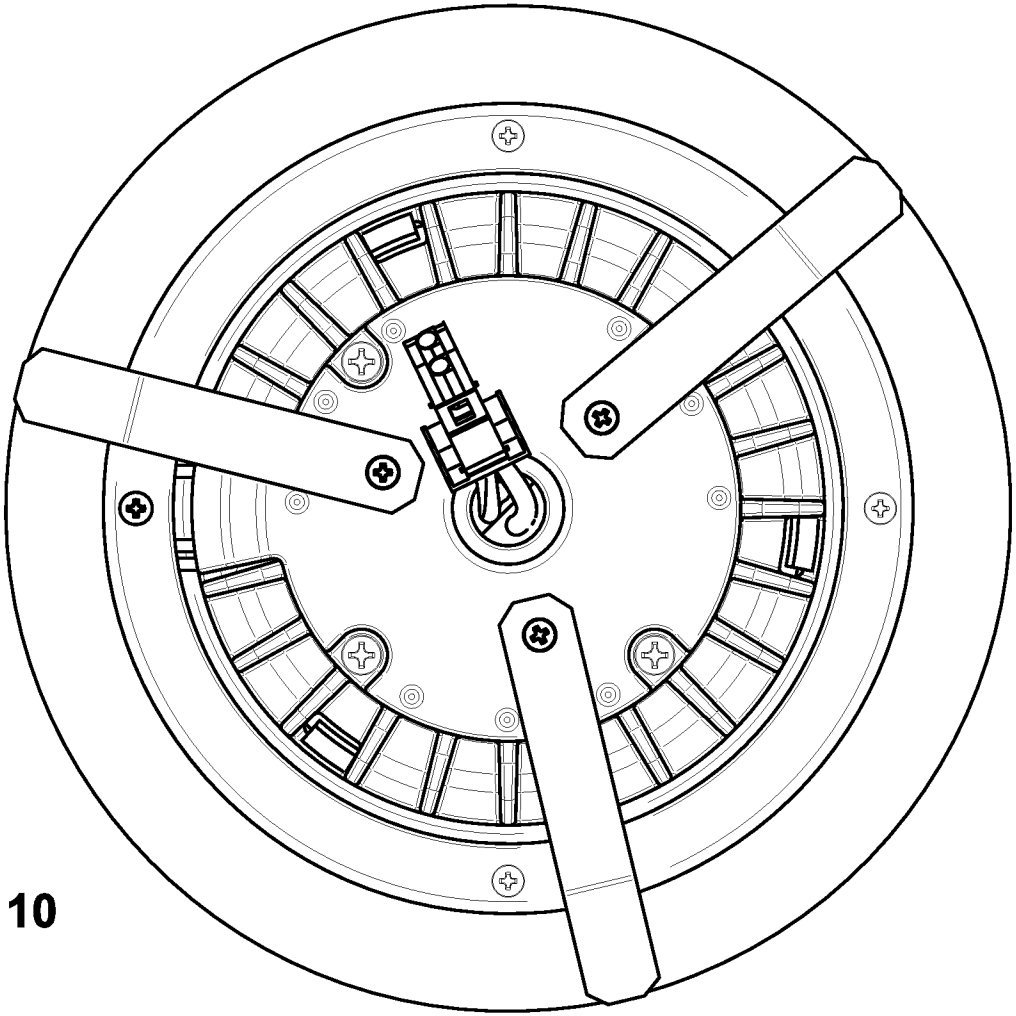
FIG. 10 is a top view of the embodiment of FIG. 1.
Figure 11:
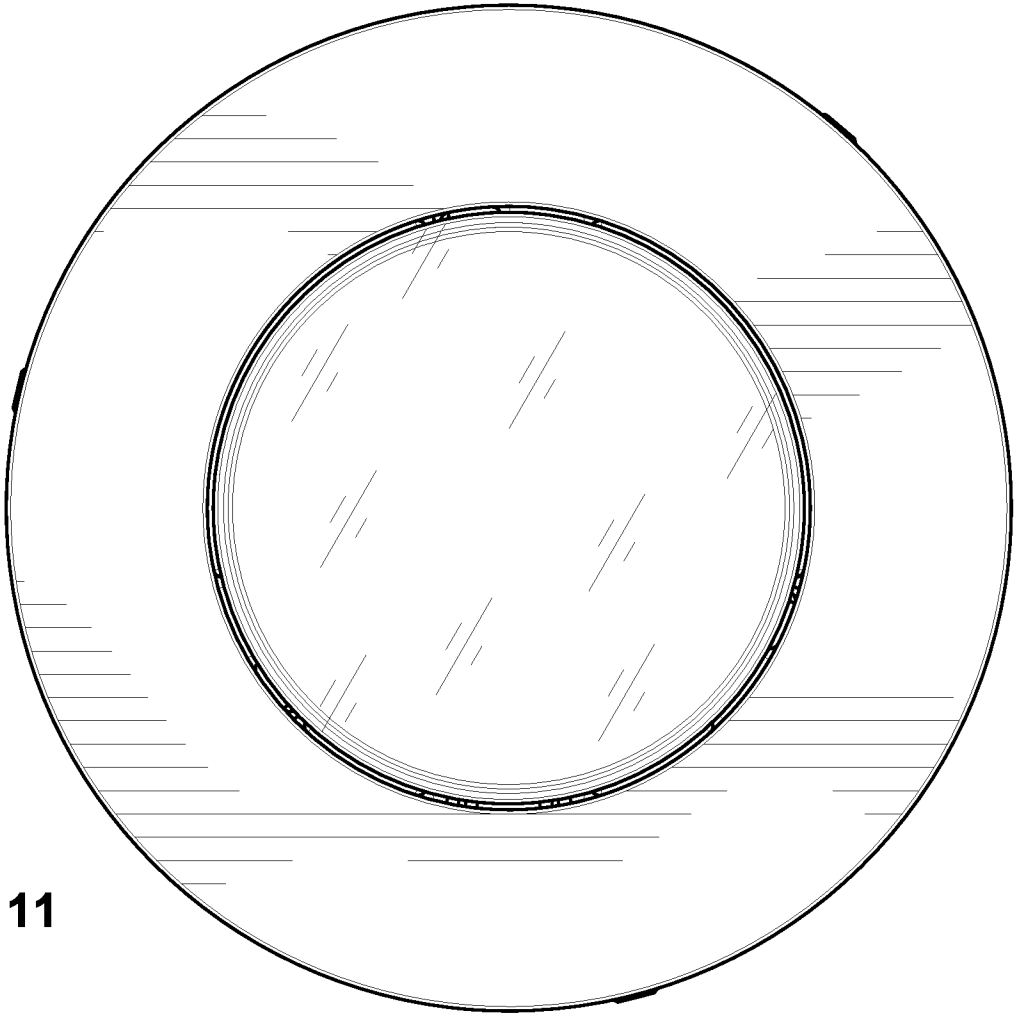
FIG. 11 is a bottom view of the embodiment of FIG. 1.

Turning now to FIG. 4, a top-down cross-section of light fixture 100 is illustrated, with upper cavity 134 exposed. As can be seen in this view, power supply input leads 140 extend through upper cavity 134 and into channel 144. Likewise, power supply output leads 142 extend out of channel 144, into upper cavity 134, through aperture 146 forming dividing wall 136, and connect with light source 120.

Claims 5-11 illustrate various aesthetic features of one embodiment of the invention.

As described herein, light fixture 100 overcomes the above-described problems associated with existing recessed LED light fixtures by utilizing a power supply 104 which is mounted below a light source 120 relative to an opening of its associated housing assembly from which light is emitted. Such a configuration allows for a higher power output power supply to be utilized given that the base environmental temperature of the power supply is reduced. Further, such a configuration allows for the higher placement of a light source within a housing to thereby reduce glare and direct line-of-sight of the light source.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A recessed LED lighting fixture configured for installation in a ceiling in an installed position, the recessed LED lighting fixture comprising:

a housing assembly having an opening in a bottom face thereof, the opening communicating with a recess of the housing assembly;

a LED light source positioned within the recess of the housing assembly and mounted to an interior mounting surface of the recess such that it emits light through the opening of the housing assembly;

a power supply mounted to the housing assembly below the LED light source in the installed position.

2. The recessed LED lighting fixture of claim 1, wherein the housing assembly comprises a housing body and a removable housing cover.

3. The recessed LED lighting fixture of claim 1, wherein the housing assembly comprises a housing body and wherein the mounting surface is provided by a dividing wall of the housing body bounding the recess, and wherein a aperture is formed in the dividing wall for routing electrical lead wires to the LED light source.

4. The recessed LED lighting fixture of claim 3, wherein the housing body includes a trim ring extending radially outward adjacent a lower most extent of the housing body, the trim ring including defining an upper surface and a lower surface, the power supply mounted to the upper surface.

5. A recessed LED lighting fixture, comprising:

a generally cylindrical housing assembly having an opening in a bottom face thereof, the opening communicating with a recess of the housing assembly;

a LED light source positioned within the recess of the housing assembly such that it emits light through the opening of the housing assembly;

a power supply mounted to an exterior of the housing assembly upon a trim ring thereof such that it is radially outside of the recess and axially interposed between the opening and the LED light source along a longitudinal axis of the housing assembly.

6. The recessed LED lighting fixture of claim 5, wherein the housing assembly recess is divided, by a dividing wall, into an upper cavity and a lower cavity, wherein the LED light source is mounted to the dividing wall within the lower cavity.

7. The recessed LED lighting fixture of claim 6, wherein housing assembly includes a housing cover and a housing body, the housing body defining the upper and lower cavities, the housing cover capping the upper cavity and including an arm which extends axially along a length of the housing body and encloses a channel between the housing body and the arm.

8. A method for retrofitting a structure with a recessed LED lighting fixture, the method comprising the steps of:

removing an existing recessed lighting fixture from an opening in a ceiling; and installing a recessed LED lighting fixture into the opening of the ceiling, the recessed LED lighting fixture comprising a housing assembly having an opening in a bottom face thereof, the opening communicating with a recess of the housing assembly, wherein a LED light source is positioned within the recess of the housing assembly such that it emits light through the opening of the housing assembly, and wherein a power supply is mounted to the housing assembly below the LED light source such that it is axially interposed between the opening and the LED light source in the installed position.

9. The method of claim 8, wherein the step of installing includes flush mounting a trim ring of the housing assembly with a mounting surface, wherein the power supply is mounted to an upper surface of the trim ring and is radially outside of the recess of the housing assembly.

10. The method of claim 9, wherein the step of flush mounting the trim ring includes flush mounting a portion of an upper surface thereof such that the power supply at least partially extends into the opening in the ceiling.

* * * * *